US005678327A

United States Patent [19]

Halberstadt

[11] Patent Number: 5,678,327

[45] Date of Patent: Oct. 21, 1997

[54] SHOE WITH GAIT-ADAPTING CUSHIONING MECHANISM

[76] Inventor: Johan P. Halberstadt, 285 Peregrine Cir., Broomfield, Colo. 80020

[21] Appl. No.: 524,726

[22] Filed: Sep. 6, 1995

Related U.S. Application Data

[63] Continuation-in-part of Ser. No. 260,718, Jul. 21, 1994, abandoned.

[51] Int. Cl.[6] ..... A43B 13/18; A43B 21/30

[52] U.S. Cl. ..... 36/27; 36/38; 36/28

[58] Field of Search ..... 36/27, 28, 38, 36/35 R, 7.8

[56] References Cited

U.S. PATENT DOCUMENTS

| | | | |
|---|---|---|---|
| 1,088,328 | 2/1914 | Cucinotta . | |
| 1,736,609 | 11/1929 | Letourneau | 36/7.8 |
| 4,259,792 | 4/1981 | Halberstadt | 36/28 |
| 4,342,158 | 8/1982 | McMahon et al. | 36/35 |
| 4,372,058 | 2/1983 | Stubblefield | 36/32 |
| 4,638,575 | 1/1987 | Illustrato | 36/28 X |
| 4,815,221 | 3/1989 | Diaz | 36/28 X |
| 4,881,329 | 11/1989 | Crowley | 36/38 |
| 5,005,299 | 4/1991 | Whatley | 36/25 |
| 5,060,401 | 10/1991 | Whatley | 36/25 |
| 5,086,574 | 2/1992 | Bacchiocchi | 36/28 X |
| 5,212,878 | 5/1993 | Burke et al. | 36/27 |
| 5,337,492 | 8/1994 | Anderie et al. | 36/28 |
| 5,343,639 | 9/1994 | Kilgore et al. | 36/29 |

FOREIGN PATENT DOCUMENTS

| | | | |
|---|---|---|---|
| WO91/11924 | 2/1991 | WIPO . | |
| 9208384 | 5/1992 | WIPO | 36/28 |

*Primary Examiner*—Ted Kavanaugh

*Attorney, Agent, or Firm*—Flehr Hohbach Test Albritton & Herbert

[57] ABSTRACT

An athletic shoe incorporating a cushioning and gait-adapting device which provides resilient cushioning while adapting to the gait of the user during running and other athletic activities. The shoe comprises an upper and a sole with the sole having a heel with medial and lateral ground-engaging elements. A cushioning and energy return and gait-adapting device is provided and comprises a support structure and one or more spring devices. Each spring device has a generally U-shaped pivot or swivel section and lateral and medial resiliently flexible pods. The pivot section has a midportion which is supported by the pivot cradle of the support structure. Resilient flexing of the lateral pod responsive to weight-bearing forces causes reaction forces to be applied across to the medial pod which is then caused to flex so that the medial pod is brought into an orientation for contact with the ground.

20 Claims, 9 Drawing Sheets

SHOE WITH GAIT-ADAPTING CUSHIONING MECHANISM

CROSS REFERENCE TO RELATED APPLICATION

This is a continuation-in-part of application Ser. No. 08/260,718 filed Jul. 21, 1994 now abandoned.

BACKGROUND OF THE INVENTION

1. Field of the Invention

This invention relates in general to footwear, and more particularly relates to athletic footwear.

2. Description of the Related Art

Many improvements have been made in prior art running shoes and other athletic footwear in an attempt to alleviate various physiological problems and injuries that derive from shortcomings in shoe designs. Among the prior art improvements to overcome these problems are the use of cushion pads or spring devices placed within the heel and/or under the ball portion of the foot. These arrangements, however, often cause instability of the shoe which in turn can lead to various problems and injuries during running or other athletic activities.

Most prior art, such as U.S. Pat. No. 4,372,058 to Stubblefield, deals mainly with vertical force and the absorption and/or deflection of that force. However, it is not only vertical force that can cause injuries. Excessive pronation and re-supination can lead to inordinate tarsal and tibial torsion, ankle and knee injuries, plantar fasciitis (caused from excessive loading of the plantar fascia tendon under the foot) and other foot problems. Because of lateral instability some designs cause the foot to have to pronate much more and at a greater velocity than normal.

In the typical running gait the anatomical structure of the human body is such that when the heel initially strikes the surface, the runner's foot is in a supinated position. When running barefoot the heel has the ability to distort under the calcaneus (heel bone) to gain stability, as illustrated in FIG. 1*b* where there is ground contact (area between dotted lines) on both sides of the line indicating the mid-point underneath the heel. FIG. 2*a* illustrates a back view of the right foot of an older type non-flared running shoe. FIG. 2*b* shows the situation at heel strike when this shoe is worn by a runner having a maximum amount of supination (18°–20°). One can see that the ground contact area is very narrow (area under dotted lines) because of the supinated angle of heel strike. In addition, the fact that the ground contact area is only on the lateral side of axis line y1—y1 (indicating the latitudinal mid-point under the calcaneus), means that an unnatural force is created which encourages the heel to rotate inwards (pronate), and at an accelerated rate.

FIG. 3*b* illustrates the same situation as FIG. 2*b* except that the shoe is of a flared type with a heel counter reinforcement. While the ground contact area is typically marginally wider and more cushioning material is used in a flared shoe, the disadvantage is that the distance between axis line y1—y1 and the ground contact area to the right of it, has been increased. This increases the lever arm which in turn can increase the amount and speed of the undesirable pronation force.

FIG. 4*b* shows a shoe according to U.S. Pat. No. 4,372,058 to Stubblefield, also at heel strike as per FIGS. 2*b* and 3*b*. Although the ground contact area between the dotted lines is significantly larger than in FIGS. 3*b* or 2*b*, the distance between the ground contact area to line y1—y1 has not been reduced. Thus the lever arm causing and accelerating the unwanted inward rotation is still present.

FIGS. 6*a* and 6*b* show a shoe designed as per Ellis in International Patent Application No. PCT/US91/00720. Ellis points out that conventional shoe soles are extremely rigid in the frontal plane and become highly unstable when tilted sideways on their very narrow bottom sole edge. The Ellis design seems to solve the instability problems by using a flexible construction method involving longitudinal sipes or channels, which allows the shoe sole to deform in a way that closely follows the way the human foot does during barefoot locomotion. However, although the Ellis design allows for a more natural gait cycle to avoid the serious interference with natural foot and ankle biomechanics inherent in shoes made as per FIGS. 2,3 and 4 above, problems with regard to shock absorption (most sports are conducted on hard surfaces) and return of energy (rebound) are not solved. Another disadvantage is that debris such as gravel, twigs, small stones and the like, could become imbedded in the sipes.

The prior art also includes U.S. Pat. No. 5,343,639 to Kilgore et al, which is directed to a midsole including one or more foam columns disposed between an upper and lower plate. Different embodiments include for example, elastic rings disposed around the columns, and inflatable gas bladders disposed in hollow regions. U.S. Pat. No. 1,088,328 to Cucinotta discloses the placement of coil springs under the heel and under the forefoot. The springs under the center section of the heel are somewhat larger and stronger than those on the periphery. While both these patents address cushioning and rebound aspects with regard to vertical force, unwanted unnatural force causing lateral instability is not taken into account. (See FIGS. 7 and 8).

The prior art further includes U.S. Pat. No. 5,212,878 to Burke which discloses an athletic shoe having a sole with a receptacle in which a removable insert is fitted. The insert is formed with cavities containing elastomeric blocks which act as compression springs for absorbing energy when the heel of the shoe strikes the ground. This arrangement does not solve the biomechanical problems of providing both cushioning and stability throughout the entire inward rotation motion as the shoe strikes the surface, nor does it automatically adapt to individual running gaits nor adjust to different types of surfaces without changing inserts.

U.S. Pat. No. 5,060,401 to Whatley provides a shoe in which spring clips can be fitted around the outer back of the heel as well as on the side of the midsole. The purpose of the spring clips is to absorb shock and to release the stored spring energy upon rebound. This arrangement also does not solve the biomechanical problems discussed above.

U.S. Pat. No. 4,342,158 to McMahon provides a shoe with removable cone-shaped springs in the heel portion. The cones are filled with a resilient material to provide a spring constant that is desired for the particular running conditions. This design, however, does not accommodate variation of lateral components of heel movement, and does not solve the biomechanical problems discussed above.

U.S. Pat. No. 4,881,329 to Crowley provides a shoe with a midsole having lateral openings into which oval-shaped springs are fitted. The purpose is to provide cushioning in the vertical direction, but the design does not adapt for lateral components of movement and does not solve the biomechanical problems discussed above.

U.S. Pat. No. 4,372,058 to Stubblefield has cantilevered lugs allowing for absorption of some vertical force and deflecting it outwardly. Whatley, U.S. Pat. No. 5,005,299 points out that the cantilevers would not deflect and return enough of the vertical force so he introduced elasticized connections between lugs. The elasticized connections would apparently store more kinetic energy on ground strike and return it to the wearer in the rebound phase. However, these systems do not address the problem of lateral instability and excessive as well as increased speed of inward rotation immediately after normal heel strike which occurs laterally.

FIG. 5b illustrates a shoe at heel strike similar to FIGS. 2b, 3b and 4b. This shoe is constructed in accordance with the present inventor's prior Halberstadt U.S. Pat. No. 4,259,792 and has a central longitudinal groove on the underside of the heel area which separates a pair of outwardly flaring fins. It can be seen that the ground contact areas (between the two sets of dotted lines) are on both sides of midline y1—y1, thus largely eliminating the aberrant unnatural pronation force present in varying strengths in FIGS. 2b, 3b and 4b. The design allows gait biomechanics much closer to natural biomechanics because of the independent action of the fins, and the broad base as well as the flexing action and compression of the fins provides excellent cushioning. Thus, both shock absorption and stability problems are addressed. However, a disadvantage has been encountered with this design in that the outward flaring sole and midsole (entirely appropriate for running and walking shoes) can be inappropriate for footwear suitable to certain activities, e.g. basketball and tennis, because of negative effects on maneuverability, and the increased probability of ankle sprains and/or tripping.

The need has been recognized for a shoe which obviates the foregoing and other limitations and disadvantages of the prior art shoes. Despite the various shoe designs in the prior art, there has not yet been provided a suitable and attractive solution to these problems.

OBJECTS AND SUMMARY OF THE INVENTION

It is a general object of the invention to provide a new and improved athletic shoe that adjusts to the user's biomechanics in such a way as to provide improved cushioning, stability and performance characteristics.

It is another object to provide an athletic shoe of the type described which provides both cushioning and stability while adapting to individual running gaits, adjusting to different types of running surfaces, and reducing heel wear.

Another object is to provide an athletic shoe that adapts to allow natural gait biomechanics thus eliminating aberrant injury causing forces found in most footwear, especially sports footwear.

Another object is to provide a more efficient cushioning device for footwear by means of a mechanical suspension system that also allows for a return of more kinetic energy to the user.

Another object is provide a self adjusting cushioning and energy return device that is suitable for all types of athletic shoes including those with narrow heels, so that critical support and cushioning in the middle of the heel area (measured laterally) is not lost.

Another object is to provide an athletic shoe of the type described in which the cushion and rebound return of energy provided in the heel can be varied by using adjustable and interchangeable pivoting spring devices that are manufactured with the desired cushioning and tensile properties.

The invention in summary provides an athletic shoe and cushioning and gait-adapting device which achieves resilient cushioning and provides energy return while adapting to the gait of the user during running and other athletic activities. The cushioning and gait-adapting device is incorporated into the heel portion of a sole which is connected to the shoe's upper. The cushioning and gait-adapting device comprises a support structure which carries a pivot or swivel cradle together with a spring device. The spring device is mounted between the support structure and the medial and lateral ground-engaging elements of the heel. The spring device is comprised of a generally U-shaped pivot section together with lateral and medial resiliently flexible pods. The pivot section is supported by the cradle for pivotal movement in a transverse direction, and the pods are positioned in resilient force cushioning relationship relative to the lateral and medial ground-engaging elements. Resilient flexing of the lateral pod causes a reaction force to be applied across to the medial pod which then flexes so that its associated ground-engaging element is positioned into an orientation for contact with the ground. Each pod comprises an upwardly convex resiliently flexible beam which reacts responsive to vertical movement of the pod's outer side to cause movement in an opposite direction of the inner side.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1A:
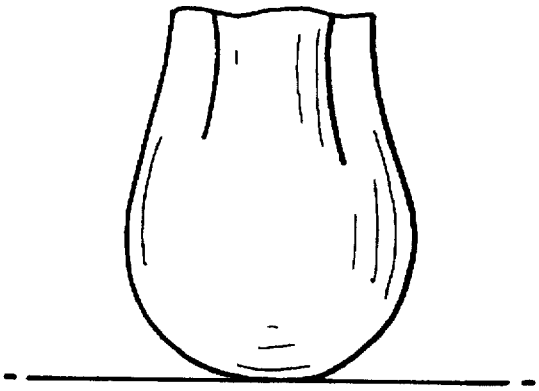
FIG 1a (PRIOR ART)
FIGS. 1a and 1b show an elevation view of the back of a human heel respectively prior to the load bearing phase and immediately after the heel strike phase.
Figure 2A:
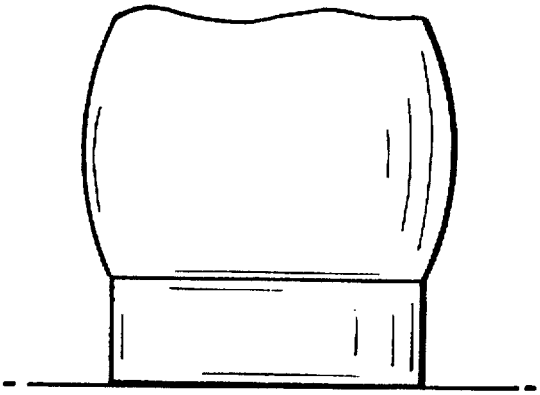
FIG 2a (PRIOR ART)
FIGS. 2a and 2b show an elevation view of the rear of the heel portion of a non-flaring prior art running shoe respectively in neutral position and in a supinated position at heel strike.
Figure 1B:
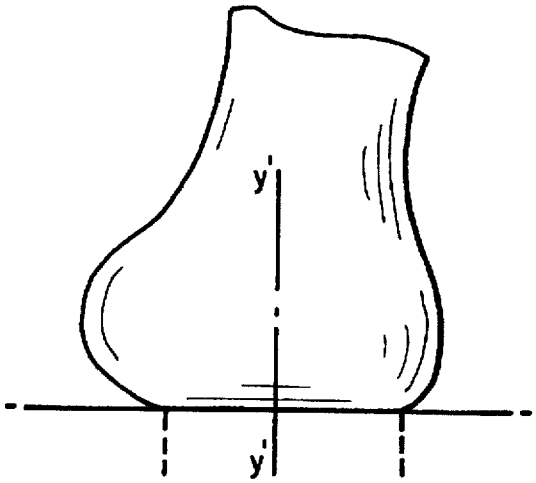
FIG 1b (PRIOR ART)
Figure 2B:
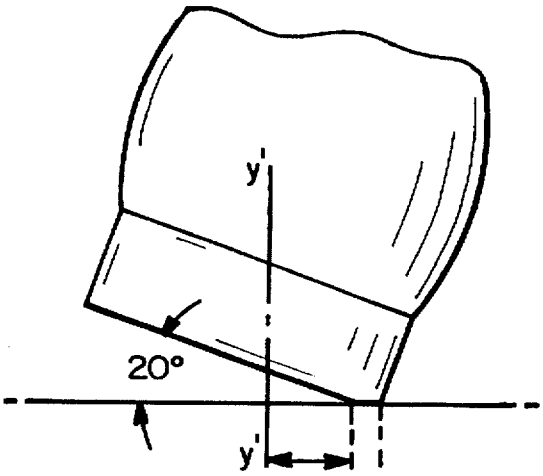
FIG 2b (PRIOR ART)
Figure 3A:
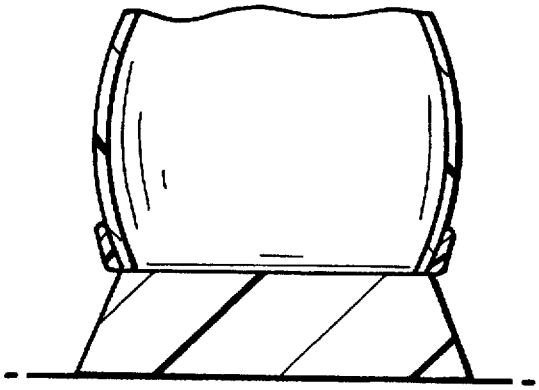
FIG 3a (PRIOR ART)
FIGS. 3a and 3b show in vertical cross sectional view through the heel portion of a prior art running shoe with rigid heel counter and reinforcing motion control device respectively in the neutral position and supinated position at heel strike.
Figure 4A:
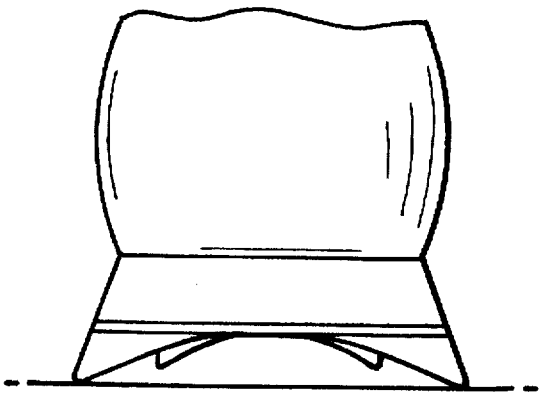
FIG 4a (PRIOR ART)
FIGS. 4a and 4b show an elevation view of the heel portion of a prior art cantilevered lug system in accordance with the Stubblefield U.S. Pat. No. 4,372,058.
Figure 3B:
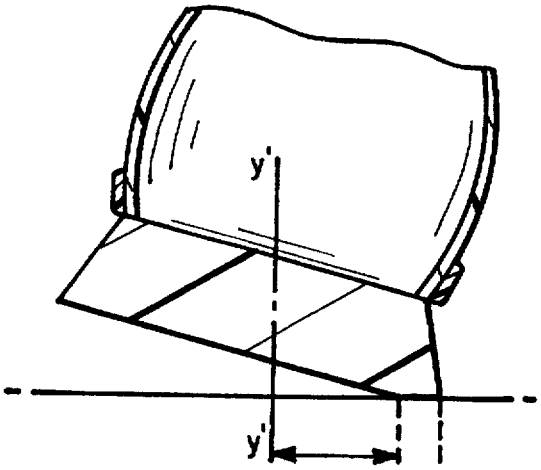
FIG 3b (PRIOR ART)
Figure 4B:
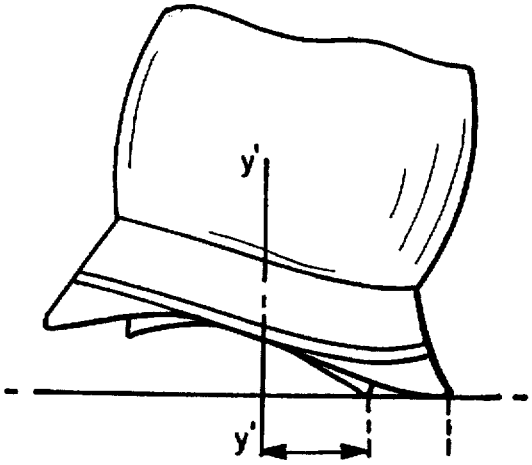
FIG 4b (PRIOR ART)
Figure 5A:
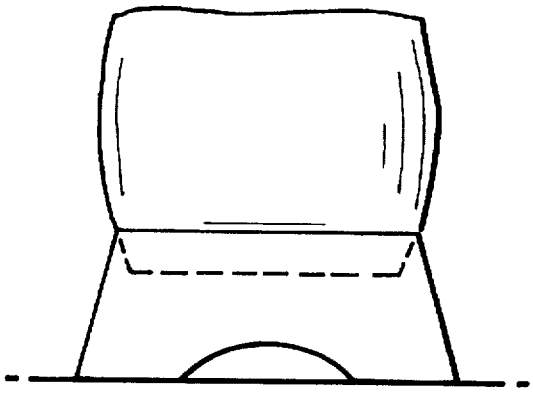
FIG 5a (PRIOR ART)
FIGS. 5a and 5b show in vertical cross section view the heel portion of a prior art right foot shoe made in accordance with the Halberstadt U.S. Pat. No. 4,259,792 respectively in neutral position and in a supinated position at heel strike.
Figure 6A:
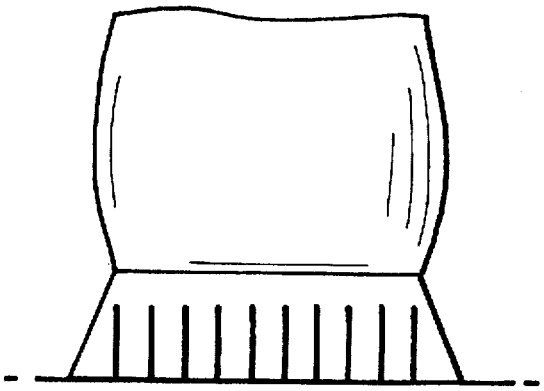
FIG 6a (PRIOR ART)
FIGS. 6a and 6b show in vertical cross section view the heel portion of a prior art shoe made in accordance with International Patent Application PCT/US91/00720 to Ellis respectively in neutral position and immediately after heel strike.
Figure 5B:
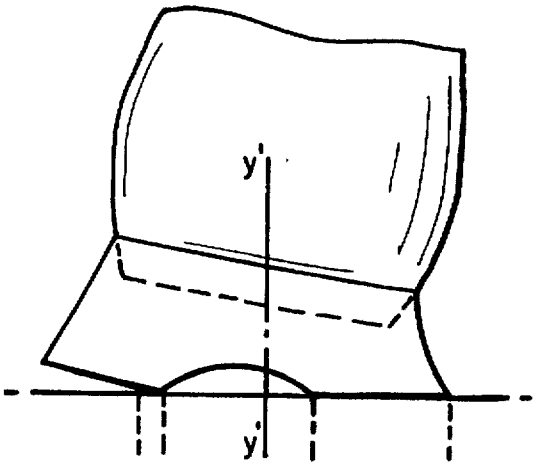
FIG 5b (PRIOR ART)
Figure 6B:
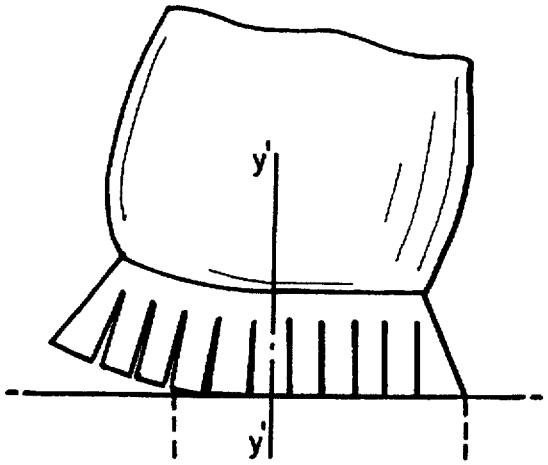
FIG 6b (PRIOR ART)
Figure 7A:
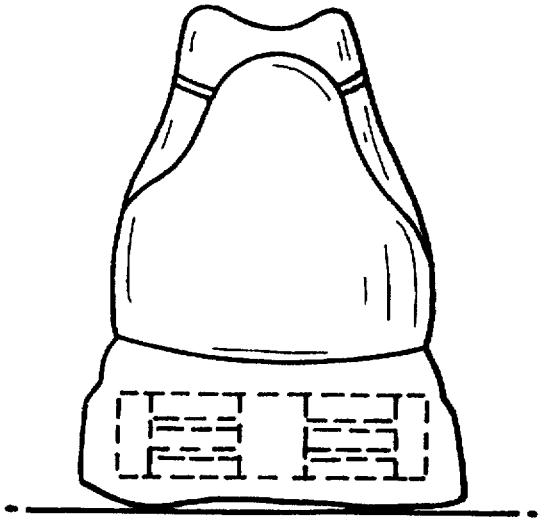
FIG 7a (PRIOR ART)
FIGS. 7a and 7b show an elevation view of the heel portion of a prior art right foot shoe made in accordance with Kilgore U.S. Pat. No. 5,343,639 respectively in neutral position and immediately after heel strike.
Figure 8A:
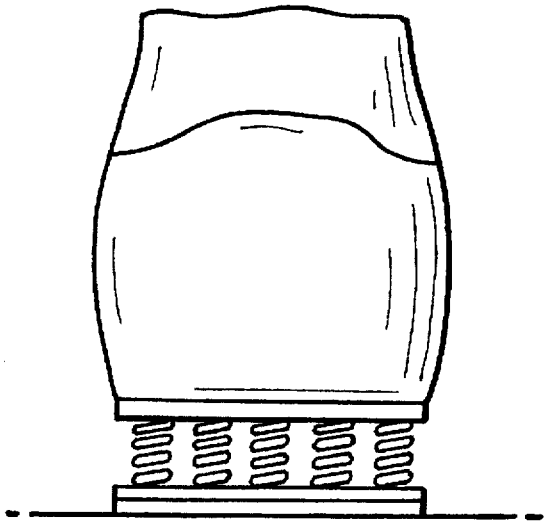
FIG 8a (PRIOR ART)
FIGS. 8a and 8b show an elevation view of the rear of the heel portion of a prior art right foot shoe made in accordance with Cuccinotta U.S. Pat. No. 1,088,323 respectively in neutral position and immediately after heel strike.
Figure 7B:
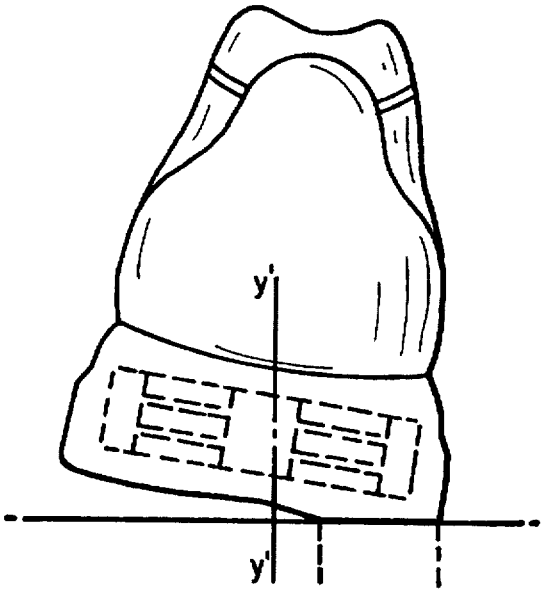
FIG 7b (PRIOR ART)
Figure 8B:
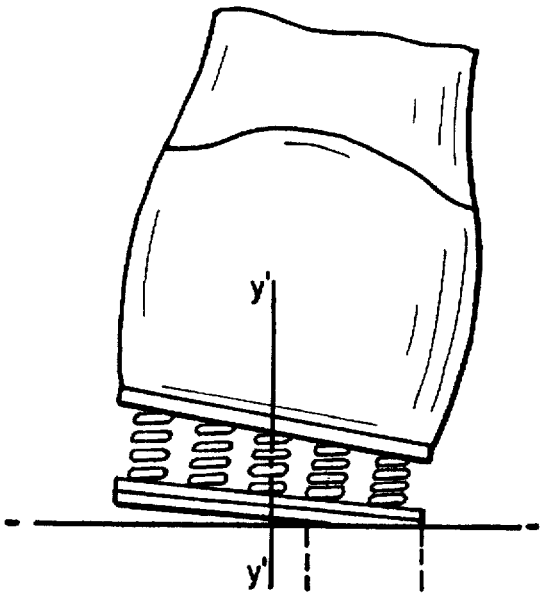
FIG 8b (PRIOR ART)

In the drawings, FIGS. 9–15 indicate generally at 20 an athletic shoe which incorporates one preferred embodiment of the invention. While this shoe is shown in the style of a running shoe, it is understood that the invention has application in other footwear for activities such as other types of athletics, particularly basketball and tennis, and also for aerobic walking where cushioning and stability are important considerations.

Figure 11:
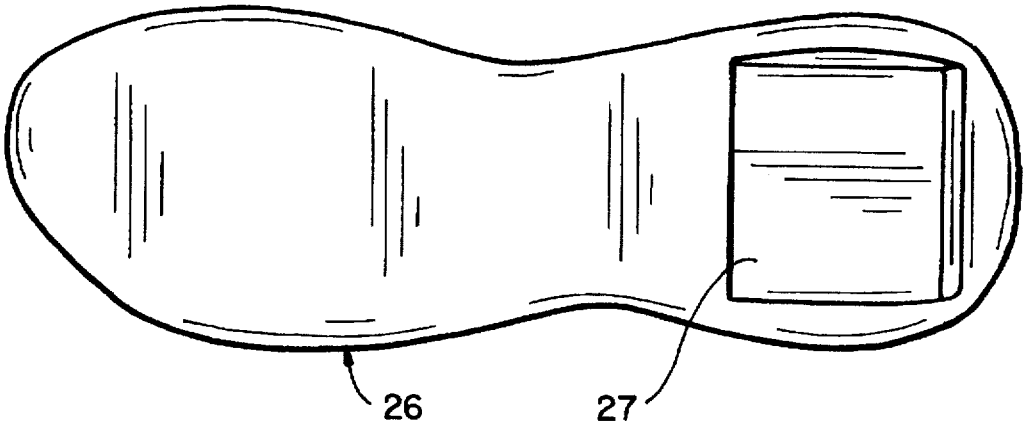
FIG. 11 is a bottom plan view of the midsole taken along the line 11—11 of FIG. 9.

Shoe 20 is comprised of an upper 22 adapted to fit about the user's foot, together with a sole 24 which is connected with the upper. Sole 24 is comprised of a midsole 26 that can be formed of a suitable flexible and resilient cushioning material such as microcellular polyurethane-elastomer, or a vinyl derivative. A cavity 27, best shown in FIG. 11, is formed in the bottom of the midsole at the shoe's heel for fitting with and containing a pair of cushioning and gait-adapting devices 29, 31.

Figure 14:
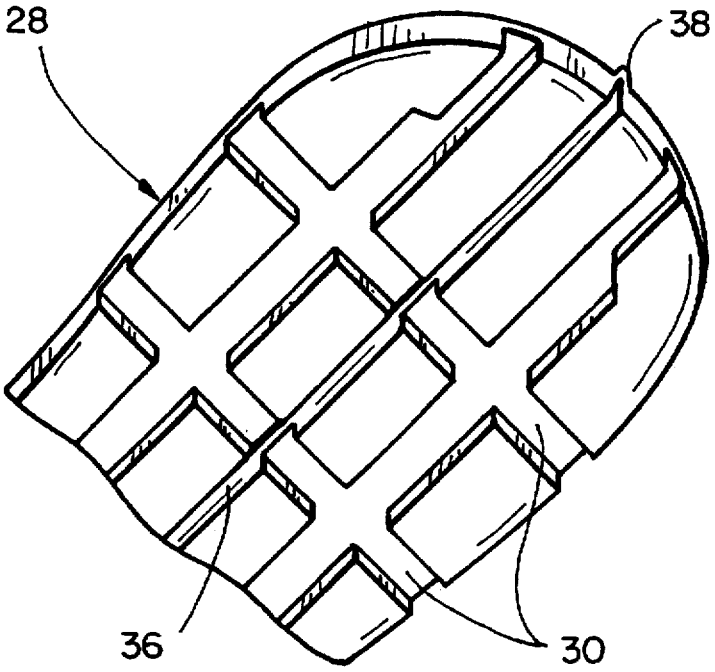
FIG. 14 is a fragmentary perspective view showing the underside of the outsole shown in FIG. 12.

Attached below the midsole is an outsole 28 which is comprised of a suitable hard-wearing flexible material. Preferably the bottom of the outsole is molded with grooves 30 which form a suitable tread pattern, as shown in FIG. 14. The outsole is divided into a pair of side-by-side ground-engaging elements 32, 34 by a gap 36 which extends along the longitudinal centerline of the shoe. In the drawings the shoe 20 for the user's right foot is illustrated so that the ground-engaging element 32 is the medial one, i.e. toward the inside of the runner, while the element 34 is the lateral one, i.e. toward the outside. The gap 36 between the medial and lateral elements is closed by suitable means such as using a hard-wearing flexible rubber. The rubber is molded into a thin and very flexible elastic strip 38 in the manner of a pleat which extends along and is integrally joined with the two ground-engaging elements along the gap. This pleat accommodates relative movement of the inner edges of the ground-engaging elements while also preventing intrusion into the midsole channel 40 and cavity 27 of debris such as pebbles, twigs, mud and the like.

While the illustrated embodiment shows a pair of the cushioning and gait-adapting devices 29, 31 mounted in the cavity, the number of such devices that can be employed would depend upon the requirements and specifications of a particular application. For example, a single cushioning and gait-adapting device could be employed, or there could be three or more, as desired. In addition, while the illustrated embodiment shows an arrangement in which the cushioning and gait-adapting devices are closed within the cavity after the outsole is secured in place, it is contemplated that an arrangement could be provided in which the cavity extends through one or both of the midsole sidewalls or backwall for exposing the cushioning and gait-adapting devices. Such an arrangement would permit access to the devices to permit them to be adjusted, interchanged or replaced.

Cushioning and gait-adapting device 29 is typical of the two devices and is comprised of a support structure 42 which is molded in the form a thin flat plate of a suitable material which has the desired flexibility while providing sufficient support for the midsole area below the user's heel. A composite material comprised of carbon fibers, which can be combined with glass, impregnated in a toughened acrylic resin is suitable for this purpose.

Figure 13:
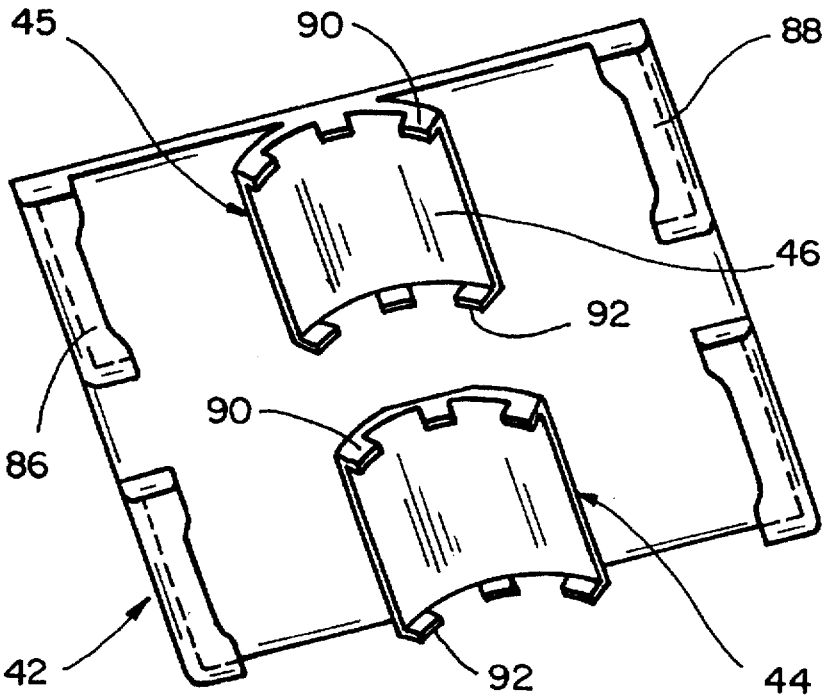
FIG. 13 is a perspective view, to an enlarged scale, of the bottom of the support structure which forms a component of the cushioning and gait-adapting device shown in FIG. 12.

The lower side of support structure 42 is molded into a configuration which provides a pair of pivot or swivel cradles 44 and 45, which are shown in detail in FIG. 13. The pivot cradles are each formed into a downwardly concave pivot or swivel surface 46 which advantageously can conform to a section of a cylinder which is axised longitudinally of the shoe. Cushioning and gait-adapting device 29 further comprises a spring device 48 which is mounted in supporting relationship between support plate 42 and ground-engaging elements 32, 34 of the heel. The spring device is resiliently flexible in a transverse direction of the shoe while at the same time being resistant against bending in a longitudinal direction. This capability is achieved by fabricating each spring device 48 of suitable thin flat strips of spring material, such as spring metal, formed into a generally U-shaped pivot section 50 together with medial and lateral resiliently flexible pods 52, 54 (best shown in FIG. 15 for device 29) which are positioned in side-by-side relationship transversely of the shoe's longitudinal axis. Pivot section 50 is formed with an arcuate midportion 56 having an upper surface which is shaped commensurate with downwardly concave pivot surface 46 of the cradle 45. This permits the midportion to pivot or rotate back and forth within the pivot section about a longitudinal axis.

Lateral pod 54 is formed into an upstanding, outwardly concave outer side 58 which is integrally joined with a horizontally inwardly extending flat arm 60 having at its distal end a vertically upright tab 62. The lateral pod is further comprised of an inwardly concave inner side 64 that integrally joins at its lower end with a horizontal arm 66 formed at its distal end with vertical upright tab 68. Inner side 64 is joined integrally with arcuate midportion 50. The lateral pod further comprises an upward convex resiliently flexible beam 70 which is positioned between and extends across the lower ends of the inner and outer sides. Beam 70 is formed of a thin layer of spring material such as spring metal. Vertical movement in one direction of either side of the pod causes the beam to react against the opposite side for moving it in an opposing direction.

Medial pod 52 is also formed of thin flat strips of spring material and comprises an inwardly concave inner side 72 which is integrally joined with arcuate midportion 50. The lower end of the inner side is integrally joined with a horizontally flat arm 74 which has a vertically upright tab 76 at its distal end. The medial pod also has an upright, outwardly concave outer side 78 which integrally joins its lower end with a horizontal arm 80 which has at its distal end a vertically upright tab 82. An upwardly convex resiliently flexible beam 84, preferably formed of a thin flat spring material, is positioned between and extends across the lower ends of the inner and outer sides. This beam reacts responsive to vertical movement of either side to cause vertical movement in an opposite direction the opposite side.

The function of the vertical upright tabs is to provide limit stops for the pods when they are under weight bearing forces. These forces cause compression of the pods to the extent that the tabs and central portions of the beams move closer together and can ultimately come into contact.

As best illustrated in FIG. 13, the outer edges of the underside of support structure or upper plate 42 is formed with edges 86, 88 that are adapted to interfit with the upper edges of the outer sides 78, 58 of each pod. This facilitates interfitting engagement with the ends of the spring device to the supporting structure so that it can be easily clipped into and then withdrawn from the structure. In addition, the ends of the pivot cradle are formed with a plurality of tabs 90, 92 which are sized and positioned to releasably hold U-shaped midsection 50 of the spring device. Concave pivot surface 46 of the cradle can be lined with a suitable anti-friction material, such as a thin layer of foam material, not shown.

Figure 10A:
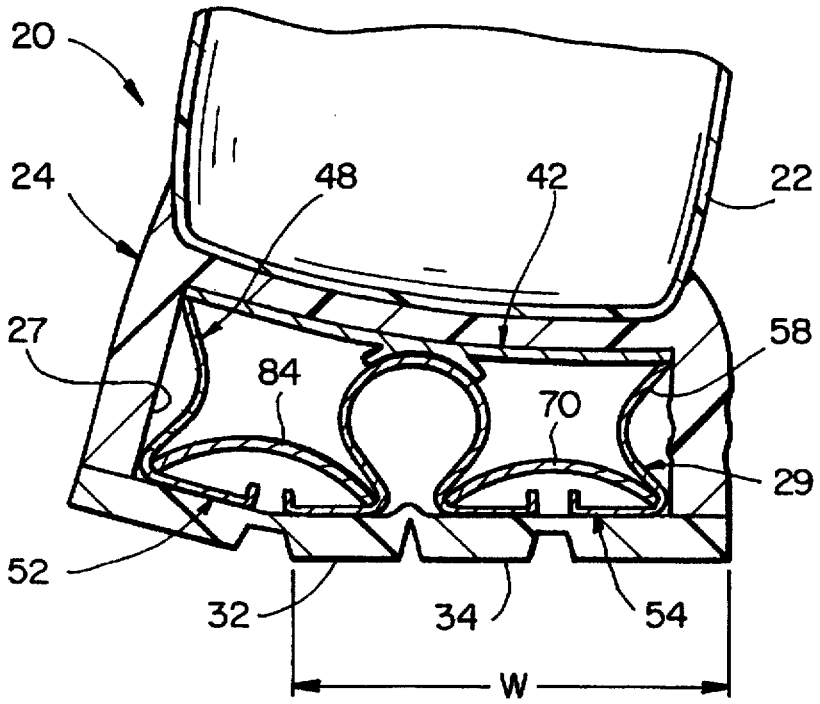
FIGS. 10a and 10b are cross sectional views, in enlarged scales, taken along the line 10—10 of FIG. 9 and which illustrate the athletic shoe of FIG. 9 respectively after heel strike and in neutral position.
Figure 10B:
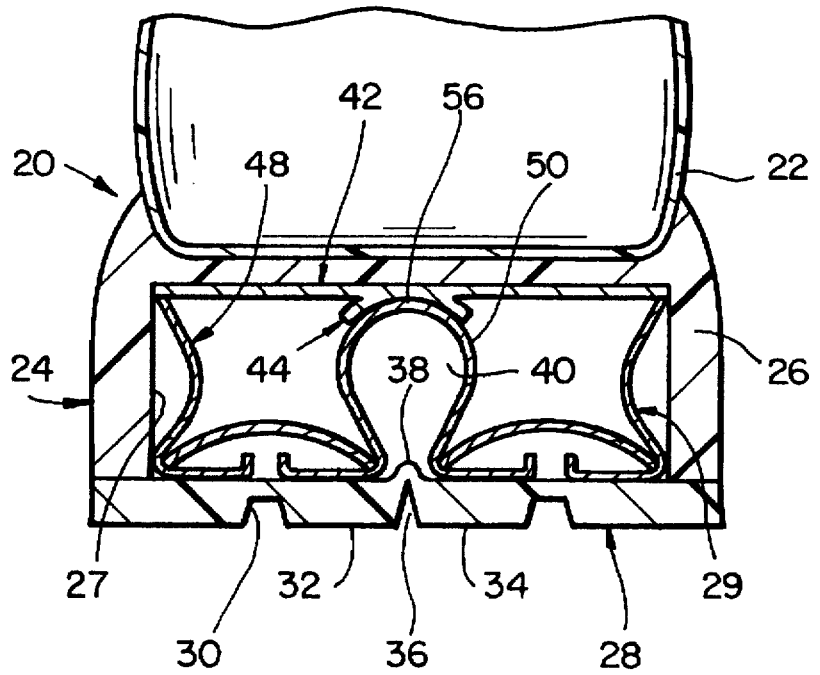
Figure 12:
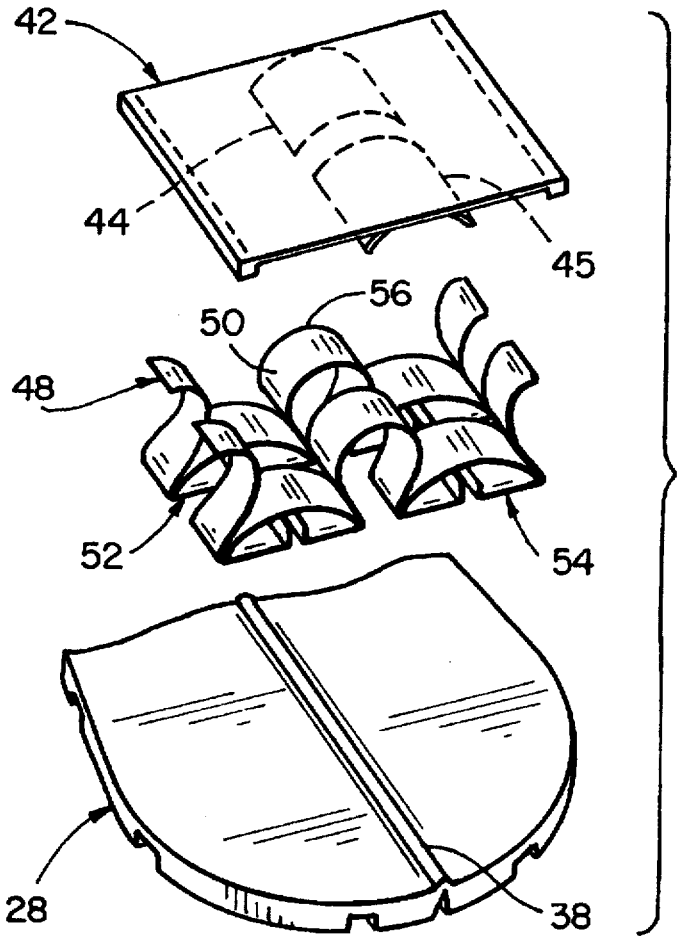
FIG. 12 is an exploded perspective view, to an enlarged scale, showing components of the cushioning and gait-adapting device of the shoe of FIG. 9.
Figure 15:
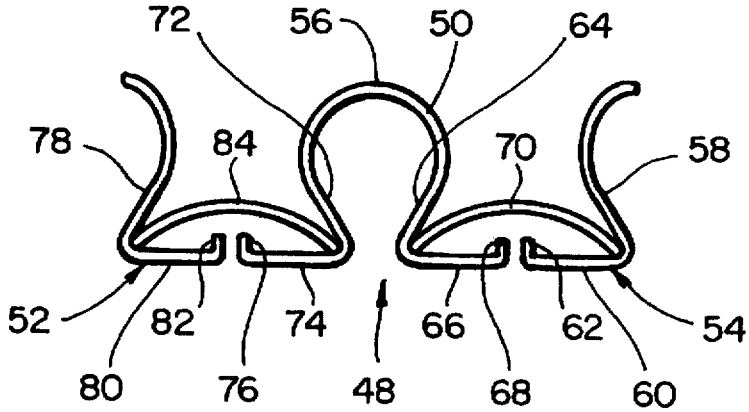
FIG. 15 is an end elevation view, in an enlarged scale, of one of the spring devices which form a part of the cushioning and gait-adapting device of FIG. 12.

FIGS. 10*a* and 10*b* illustrate the use and operation of the invention from the vantage point of the rear view of the athletic shoe for the right foot of the user. The orientation of the shoe relative to ground immediately after heel strike is shown in FIG. 10*a*. In this phase of the running gait the lateral portion of lateral pod 54 flexes upwardly (relative to the shoe) under the compressive load of the user's weight. This movement causes convex beam 70 to react so that the beam's inner edge pulls the lateral pod's inner side 64 downwardly. This causes the inner lower edge of the lateral pod to make ground contact earlier. The convex beam also acts in the manner of a single leaf spring to assist in absorbing shock forces. The arcuate midportion 56 of the pivot section can be caused to pivot in a clockwise direction, as viewed in FIG. 10*a*, within the pivot cradle.

As the user's foot and shoe continue to pronate medially toward the neutral position shown in FIG. 10*b*, and depending on the force present and the direction of this force, midportion 56 pivots within the cradle in a counterclockwise direction so that inner side 72 of medial pod 52 moves down relative to the shoe. This causes the lower inner edge of the medial pod, and thereby the lower inner edge of ground-engaging element 32, to make ground contact. As a result the user's calcaneus or heel bone and subtalar joint are not subjected to abnormal forces that otherwise could cause lateral instability. As the gait cycle continues toward the neutral position, the upward movement of the medial pod's inner side moves the inner edge of convex beam 84 upwardly which in turn causes the beam's outer edge to pull outer side 78 downwardly toward the ground. If the user, for example, is a severe pronator with excessive inward force rotating the foot into overpronation, the present invention counters this condition by the buttressing action and increased resiliency of the medial pod.

The unique pivoting action of the spring devices enhances cushioning and energy return characteristics due to the multi-faceted flexing action of the spring elements. The nature of the spring design of the pods enables the total shock load, immediately after heel strike, to be spread over a relatively wide area, shown by the width W in FIG. 10*a*, while at the same time providing outstanding cushioning and support due to the mechanical action of the device. The gait-adapting characteristics of the device are realized in that no matter what the angle of the user's foot at heel strike the pivoting and flexing action of the invention automatically adjusts so as to avoid artificial lever arm lateral instability, such as in the prior art shoes of the type shown in FIGS. 2, 3, 4, 7 and 8.

Another major benefit from the cushioning and gait-adapting device of the invention is that it can be used in practically all types of athletic footwear even where it is advantageous to have a fairly narrow heel base, rather than being widely flared as in conventional running shoes. This makes the invention particularly appropriate for use in footwear design for sports such as basketball, tennis, badminton and baseball where there can be significant lateral foot movement and where wide flaring midsoles/outsoles could be inappropriate.

Figure 16:
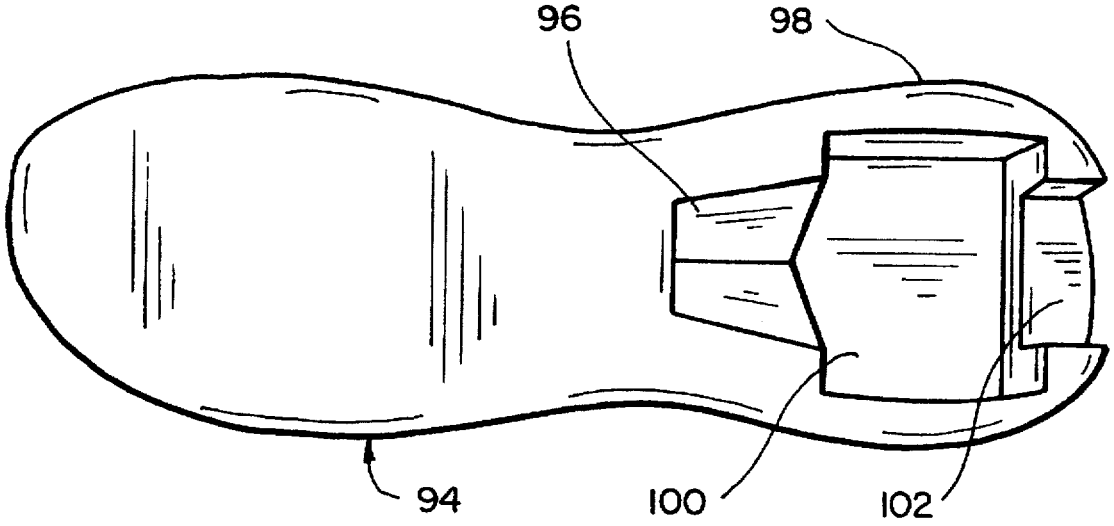
FIG. 16 is a bottom plan view, similar to FIG. 11, of the midsole of an athletic shoe in accordance with another embodiment of the invention.

FIG. 16 illustrates another embodiment providing a modified midsole 94 used in conjunction with the cushioning and gait-adapting device explained in connection with the embodiment of FIG. 9. In the midsole of FIG. 16, which is a bottom view, a V-shaped channel 96 is formed at the forward part of the heel portion 98 and extends into a cavity 100 which is provided for containing the cushioning and gait-adapting devices. A rectangular-shaped channel 102 opens into the back of the cavity and extends through the rear of the heel. This rear channel makes the cushioning and gait-adapting devices visible and accessible so that they can be adjusted, interchanged or replaced, as required. For additional visual effect, the outsole portion covering the recessed area of the midsole could be molded from transparent rubber.

Figure 9:
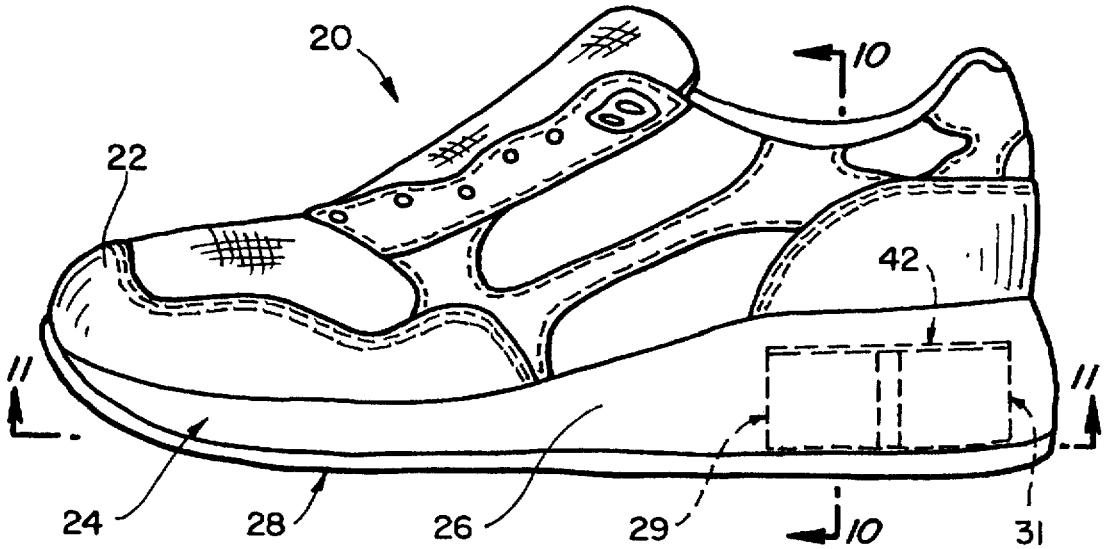
FIG. 9 is a side elevation view of an athletic shoe shown in accordance with one embodiment of the invention.
Figure 17:
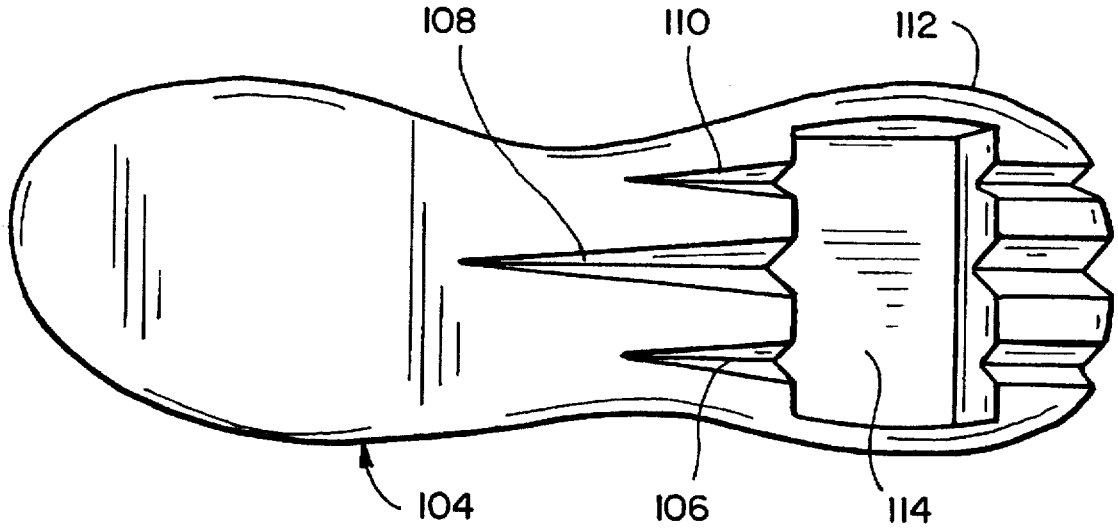
FIG. 17 is a bottom plan view, similar to FIG. 11, of the midsole of an athletic shoe in accordance with another embodiment of the invention.

FIG. 17 illustrates another embodiment providing a modified midsole 104 used in conjunction with the cushioning and gait-adapting device for the embodiment of FIG. 9. Three laterally spaced apart, longitudinally extending V-shaped channels 106, 108 and 110 are formed in the heel portion 112. Each channel opens into a recess 114 which is provided for containing the cushioning and gait-adapting devices, and the center channel 108 extends further forward and is of greater depth than the outer channels. An outsole, not shown, formed with the appropriate tread profile, is then attached to the midsole so that the devices are captured within the cavity. This configuration has a synergistic effect on the cushioning and gait-adapting devices. The channels could extend further forward, such as through the front of the forefoot, and be formed at varying and/or uneven widths and depths, depending upon the required biomechanical effects and requirements.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. An athletic shoe for wearing on the foot of a user and for providing resilient cushioning while adapting to the gait of the user during running and other athletic activities, the athletic shoe comprising the combination of an upper for fitting about the user's foot; a sole connected to the upper, the sole comprising a heel having medial and lateral ground-engaging elements which are positioned side-by-side transversely of the longitudinal axis of the shoe; a cushioning and gait-adapting device comprising i) a support structure mounted transversely across the heel of the shoe, said support structure including a swivel cradle having a downwardly concave swivel surface; ii) a spring device mounted in supporting relationship between the support structure and ground-engaging elements of the heel, said spring device being resiliently flexible in a transverse direction and further being substantially resistant against bending in a longitudinal direction, said spring device comprising a swivel section together with lateral and medial resiliently flexible pods which are positioned in side-by-side relationship transversely of said longitudinal axis, said pods being supported in resilient force cushioning relationship between respective lateral and medial ground-engaging elements and the support structure, said swivel section comprising a midportion having an upwardly convex swivel surface which slidably supports the concave swivel surface for enabling swiveling movement of the spring device relative to the swivel cradle in a direction which is transverse with respect to said longitudinal axis, and force transmitting means for transmitting reaction forces, responsive to resilient flexing of the lateral pod when weight-bearing forces are applied between the support structure and ground-engaging elements, across to the medial pod and for causing said medial pod to flex responsive to the reaction forces sufficient for positioning the ground-engaging element associated with the medial pod into an orientation for contact with the ground.

2. An athletic shoe as in claim 1 in which each pod comprises an outer side and an inner side, and said force transmitting means couples said midportion of the swivel section with the inner sides of the medial and lateral pods so that vertical movement in one direction, relative to the sole, of the inner side of the lateral pod during the heel contact phase of the gait cycle causes the inner side of the medial pod to react and move in a vertical direction opposite said one direction.

3. An athletic shoe as in claim 2 in which said force transmitting means reacts to upward vertical movement of said inner side of the lateral pod and causes said midportion to swivel relative to the swivel cradle and move the outer side of the medial pod downwardly into said orientation for contact with the ground.

4. An athletic shoe as in claim 2 in which said pod further comprises an upwardly convex resiliently flexible beam, said beam being positioned between and extending across said inner and outer sides of the associated pod so that the beam reacts responsive to vertical movement in one direction of the outer side for causing vertical movement in an opposite direction of the inner side of the associated pod.

5. An athletic shoe as in claim 4 in which each pod is further comprised of a pair of horizontally extending flat arms which are joined with and extend inwardly from the respective outer and inner sides, and at least one of the arms is formed with a vertically upright tab which contacts the beam to provide a limit stop which limits relative movement between the beam and the one arm responsive to said application of the weight-bearing forces.

6. An athletic shoe as in claim 4 in which said beam of each pod is comprised of a curved spring having a flat lateral cross section.

7. An athletic shoe as in claim 2 in which each pod is further comprised of a pair of horizontally extending flat arms which are joined with and extend inwardly from the respective outer and inner sides, each flat arm being mounted in supporting relationship with the ground-engaging element which is associated with the respective pod.

8. An athletic shoe as in claim 1 in which said sole has a cavity in the heel, and said cushioning and gait-adapting device is mounted within the cavity.

9. An athletic shoe as in claim 1 in which said cushioning and gait-adapting device comprises a plurality of said spring devices mounted in side-by-side relationship longitudinally of the shoe.

10. An athletic shoe as in claim 1 in which the swivel section and midportion of each pod are comprised of curved springs having flat lateral cross sections.

11. A cushioning and gait-adapting device for use with an athletic shoe having a sole and a heel with the heel having lateral and medial ground-engaging elements and in which the shoe is to be worn on the foot of a user so that the shoe provides resilient cushioning while adapting to the gait of the user during running and other athletic activities, the device comprising the combination of i) a support structure mounted transversely across the heel of the shoe, said support structure including a swivel cradle having a downwardly concave swivel surface, and ii) a spring device mounted in supporting relationship between the support structure and ground-engaging elements of the heel, said spring device being resiliently flexible in a transverse direction and further being substantially resistant against bending in a longitudinal direction, said spring device comprises a generally U-shaped swivel section together with lateral and medial resiliently flexible pods which are positioned in side-by-side relationship transversely of said longitudinal axis, said pods being positioned in resilient force cushioning relationship between respective lateral and medial ground-engaging elements and the support structure, said swivel section comprising a midportion having an upwardly convex swivel surface which slidably supports by the concave swivel surface for enabling pivotal movement of the spring device relative to the swivel cradle in a transverse direction, and force transmitting means for transmitting reaction forces, responsive to resilient flexing of the lateral pod when weight-bearing forces are applied between the support structure and ground-engaging elements, across to the medial pod and for causing said medial pod to flex responsive to the reaction forces sufficient for positioning the ground-engaging element associated with the medial pod into an orientation for contact with the ground.

12. A device as in claim 11 in which each pod comprises an outer side and an inner side, and said force transmitting means couples said midportion of the swivel section with the inner sides of the medial and lateral pods so that vertical movement in one direction, relative to the sole, of the inner side of the lateral pod during heel contact phase of the gait cycle causes the outer side of the medial pod to react and move in a vertical direction opposite said one direction.

13. An athletic shoe as in claim 12 in which said force transmitting means reacts to upward vertical movement of said inner side of the lateral pod and causes said midportion to swivel relative to the swivel cradle and move the outer side of the medial pod downwardly into said orientation for contact with the ground.

14. A device as in claim 12 in which said force transmitting means comprises an upwardly convex resiliently flexible beam, said beam being positioned between and extending across said inner and outer sides of the associated pod so that the beam reacts responsive to vertical movement in one direction of the outer side for causing vertical movement in an opposite direction of the inner side of the associated pod.

15. A device as in claim 14 in which each pod is further comprised of a pair of horizontally extending flat arms which are joined with and extend inwardly from the respective outer and inner sides, and at least one of the arms is formed with a vertically upright tab which contacts the beam to provide a limit stop which limits relative movement between the beam and the one arm responsive to said weight-bearing forces being applied.

16. A device as in claim 14 in which said beam of each pod is comprised of a curved spring having a flat lateral cross section.

17. A device as in claim 12 in which each pod is further comprised of a pair of horizontally extending flat arms which are joined with and extend inwardly from the respective outer and inner sides, said flat arms being mounted in supporting relationship with the ground-engaging element which is associated with the respective pod.

18. A device as in claim 11 in which said sole has a cavity in the heel, and said cushioning and gait-adapting device is mounted within the cavity.

19. A device as in claim 11 in which said cushioning and gait-adapting device comprises a plurality of said spring devices mounted in side-by-side relationship longitudinally of the shoe.

20. A device as in claim 11 in which the swivel section and midportion of each pod are comprised of curved springs having flat lateral cross sections.

* * * * *